US008985845B2

(12) United States Patent
Zaugg et al.

(10) Patent No.: US 8,985,845 B2
(45) Date of Patent: Mar. 24, 2015

(54) TIMEPIECE MOVEMENT WITH A TOURBILLON FITTED WITH A SHOCK PROTECTION DEVICE

(75) Inventors: Alain Zaugg, Le Brassus (CH); Dominique Lechot, L'Orient (CH)

(73) Assignee: Montres Breguet SA, L'abbaye (CH)

( * ) Notice: Subject to any disclaimer, the term of this patent is extended or adjusted under 35 U.S.C. 154(b) by 719 days.

(21) Appl. No.: 12/728,809

(22) Filed: Mar. 22, 2010

(65) Prior Publication Data

US 2010/0238769 A1 Sep. 23, 2010

(30) Foreign Application Priority Data

Mar. 23, 2009 (EP) ..... 09155819

(51) Int. Cl.
*G04B 15/00* (2006.01)
*G04B 17/28* (2006.01)
*G04B 43/00* (2006.01)

(52) U.S. Cl.
CPC ..... *G04B 17/285* (2013.01); *G04B 43/002* (2013.01)
USPC ..... 368/127

(58) Field of Classification Search
USPC ..... 368/124, 127
See application file for complete search history.

(56) References Cited

U.S. PATENT DOCUMENTS

| | | | | |
|---|---|---|---|---|
| 7,188,995 | B2 * | 3/2007 | Besse et al. | 368/127 |
| 7,287,900 | B2 * | 10/2007 | Rufenacht et al. | 368/127 |
| 7,316,504 | B1 * | 1/2008 | Mock et al. | 368/127 |
| 7,350,966 | B2 * | 4/2008 | Zaugg | 368/140 |
| 2005/0201209 | A1 * | 9/2005 | Golay | 368/127 |
| 2008/0144447 | A1 | 6/2008 | Ruchonnet et al. | |

FOREIGN PATENT DOCUMENTS

| | | | |
|---|---|---|---|
| EP | 1 460 493 | A2 | 9/2004 |
| WO | 2005/111741 | A1 | 11/2005 |

* cited by examiner

*Primary Examiner* — Amy Cohen Johnson
*Assistant Examiner* — Jason Collins
(74) *Attorney, Agent, or Firm* — Sughure Mion, PLLC

(57) ABSTRACT

A timepiece movement including a tourbillon that has a rotating carriage bearing a sprung balance and an escapement. The carriage includes a top pivot and a bottom pivot, respectively carried by a top bridge and a bottom bridge of the carriage. The carriage pivots between a bottom plate of the timepiece movement and a bridge of the movement in the timepiece movement includes a stop member, arranged for limiting the axial shake of the carriage.

16 Claims, 9 Drawing Sheets

TIMEPIECE MOVEMENT WITH A TOURBILLON FITTED WITH A SHOCK PROTECTION DEVICE

This application claims priority from European Patent Application No. EP 09155819 filed 23 Mar. 2009, the entire disclosure of which is incorporated herein by reference.

BACKGROUND OF THE INVENTION

The present invention concerns a timepiece movement with a tourbillon, fitted with a shock protection device. The present invention also concerns a watch fitted with this type of timepiece movement.

Tourbillon movements are mechanical devices for improving the accuracy of mechanical watches by offsetting interference with the isochronism of the balance due to the Earth's gravity. In order to do this, the regulating member that includes the balance and the escapement are mounted in a carriage, which is set in rotation, generally at the rate of one complete revolution per minute.

The tourbillon carriage is generally held in place between two pivots, respectively provided in the bottom plate of the movement and in a bridge of the movement. Alternatively, the carriage can pivot in a ball bearing, which makes it more visible from the dial side.

When it pivots between the bottom plate and a bridge, the carriage is generally formed of a bottom bridge, to which pillars carrying a top bridge are fixed, and these top and bottom bridges carry pivots which respectively rotate in a jewel carried by the bottom plate and a jewel carried by the movement bridge.

Depending upon the embodiment, the movement bridge can be formed either by an overhanging beam, or a beam that is embedded at both ends.

One drawback of these tourbillon mechanisms is their high sensitivity to shocks. Indeed, it is difficult to make a mechanism this type of resistant to accelerations of more than 3500 G without damage, while NIHS standards require resistance to accelerations of 5000 G.

In fact, if significant shocks are applied to the watch, the weight of the tourbillon carriage is such that the movement bridge bends or is deformed so that the carriage moves along its axis of rotation and causes the bottom pivot of the carriage to leave its jewel housing. Depending upon the intensity of the shock and thus the amplitude of movement of the carriage, the pivot may not return to its housing, which abruptly stops the carriage, and therefore the movement, from rotating. After a shock of this type, intervention by a watchmaker is thus necessary in order to get the watch to work again. It should be noted that, in some cases, the movement of the carriage may be such that the escape pinion is released from the toothing of the fixed second wheel, causing the barrel to be let down abruptly, which may lead to the destruction of some parts of the mechanism. This drawback is more significant in the case of a top bridge formed of an overhanging beam which has greater flexibility.

Various attempts have been envisaged to overcome this problem, such as making the carriage lighter, making the movement bridge more rigid, particularly by increasing the dimensions thereof, or even lengthening the bottom pivot of the carriage. However, these measures have not been able to provide satisfactory results without making the design more complex, and in doing so, affecting the attractiveness of the watches fitted with these mechanisms.

It is an object of the present invention to overcome the aforementioned drawbacks, in addition to others, by providing a timepiece movement with a tourbillon that has improved shock resistance compared to tourbillons of the prior art.

It is also an object of the invention to provide a timepiece movement of this type, which is has a simple, economical design and is easy to implement.

It is also an object of the invention to provide a timepiece movement of this type without affecting its usual attractive appearance.

SUMMARY OF THE INVENTION

The invention therefore concerns a timepiece movement that includes a tourbillon with a rotating carriage carrying a sprung balance and an escapement, wherein said carriage includes a top pivot and a bottom pivot respectively carried by a top bridge and a bottom bridge of the carriage, said carriage is pivoted between a bottom plate of said timepiece movement and a bridge of said movement, and the movement is characterized in that it further includes a stop member, arranged for limiting the axial shake or travel of the carriage.

Owing to these features, the shock resistance of the timepiece movement can thus be guaranteed insofar as the maximum axial movement of the carriage is predefined, so that it is impossible for the carriage pivots to leave the housing of their respective bearings.

According to an advantageous embodiment, the stop member is carried by the bottom plate of the movement and cooperates with the bottom bridge of said carriage.

According to one feature of this embodiment of the invention, a socket, carried by the bottom pivot, extends from the central part of the bottom bridge of the carriage, and said socket also carries a shoulder, with the stop member cooperating with the shoulder to limit the axial shake of the carriage.

According to another feature of the invention, the bottom pivot is housed in a bottom bearing carried by the bottom plate, and in the absence of any shock, the distance between the stop member and the shoulder is less than the length of engagement of the bottom pivot in the bearing.

According to a preferred feature, the stop member can move between a first position, called the assembly position, in which the stop member is off the axial path of the shoulder to enable the carriage to be mounted on the bottom plate, and a second position, called the operating position, in which the stop member is on the axial path of said shoulder. The stop member advantageously takes the form of an articulated lever that includes a first control part, extended by a second stop part in the arc of a circle, wherein the control part is located in an end portion of the second part, in which the hinged lever pivots. A member that locks the stop member in the operating position may also be provided to hold the stop member in this position, while the watch fitted with the movement is operating.

According to another embodiment, the stop member can be carried by the tourbillon carriage and particularly by the bottom pivot of the tourbillon carriage. In this case, the bottom pivot will project outside its bearing on the opposite side to the carriage, and the stop member could be formed, either by a washer driven onto the projecting part of the bottom pivot, or by the head of a screw that is axially screwed into the free end of the projecting part of the bottom pivot.

BRIEF DESCRIPTION OF THE DRAWINGS

The features and advantages of the present invention will appear more clearly in the following description, which is given with reference to the annexed drawings and gives, by way of explanatory, but non-limiting example, advantageous embodiments of a timepiece movement with a tourbillon according to the invention. In the drawings.

DETAILED DESCRIPTION OF ONE EMBODIMENT

Figure 1:
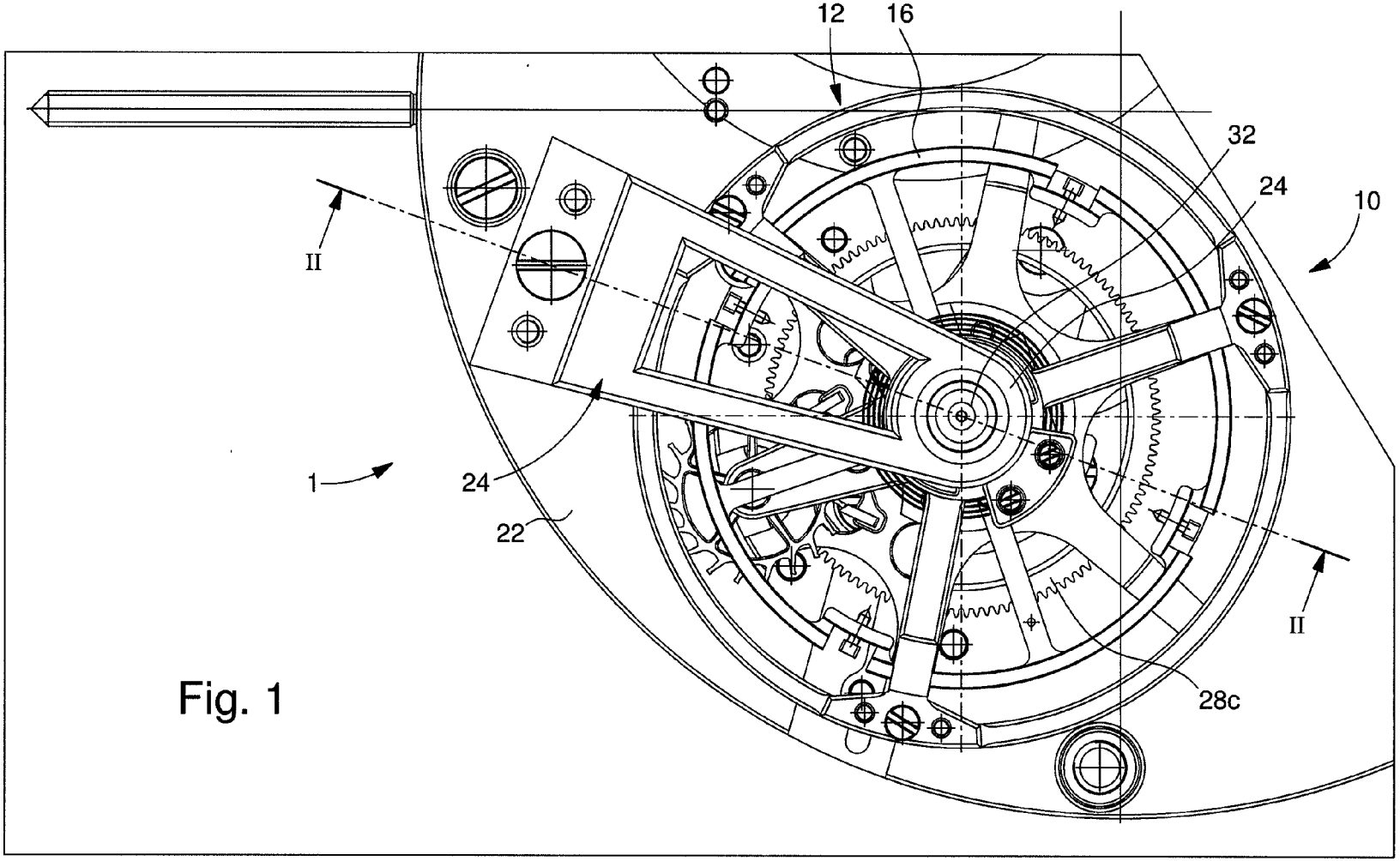
FIG. 1 is a partial top view of the timepiece movement according to the invention in the tourbillon area.
Figure 2:
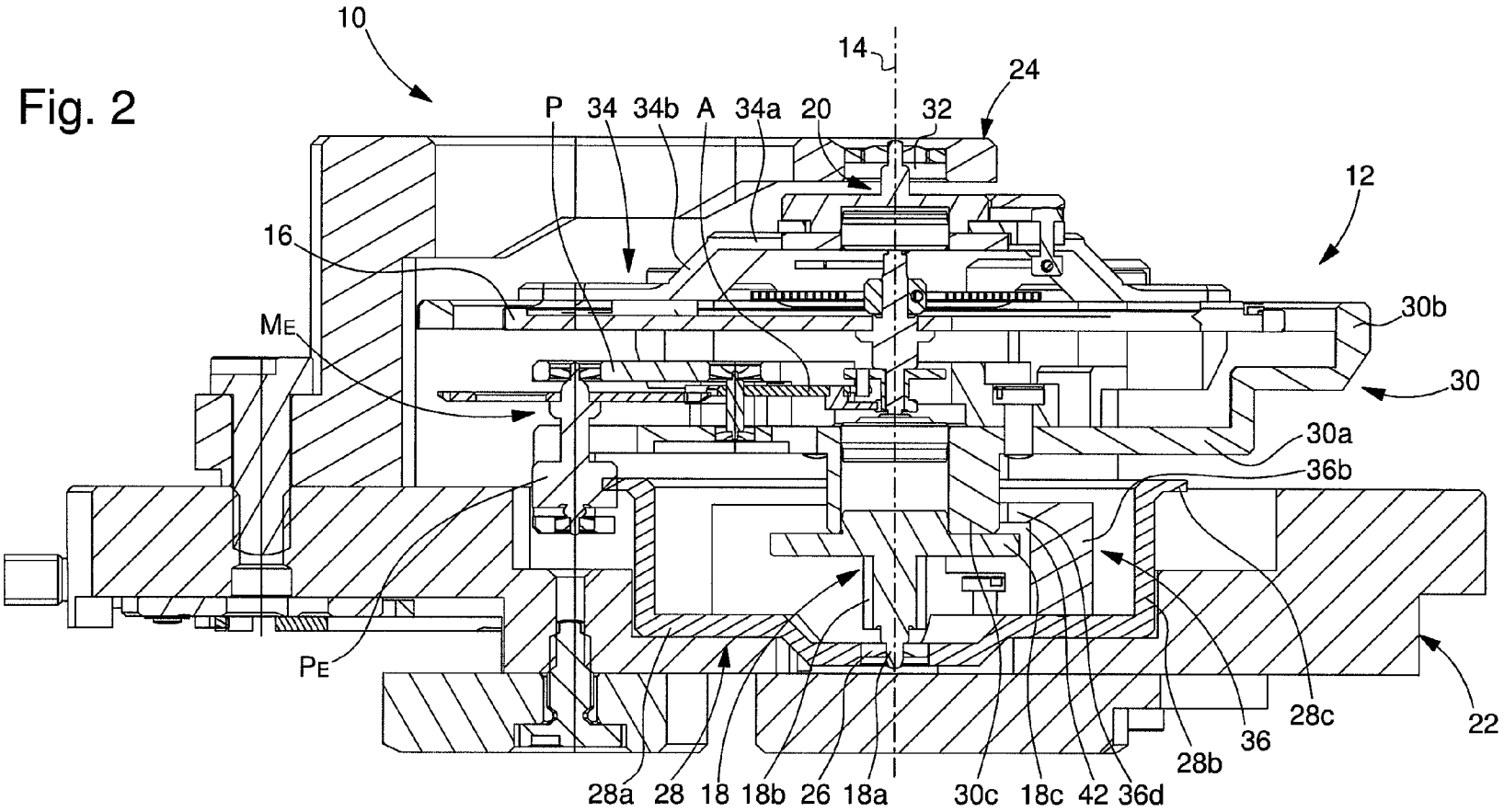
FIG. 2 is a partial cross-section of the timepiece movement along line II-II of FIG. 1 in the tourbillon area and in accordance with a first embodiment.
Figure 3:
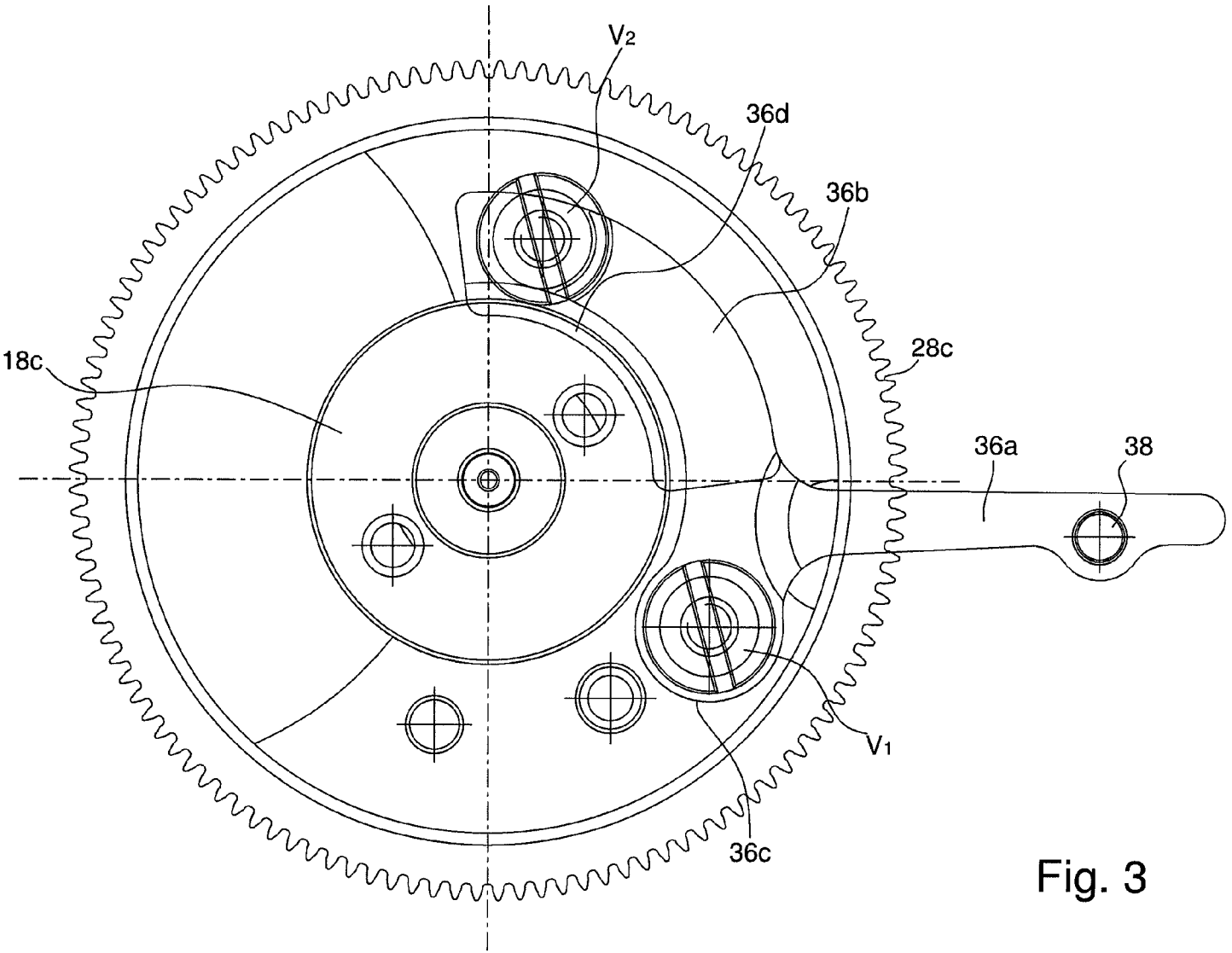
FIG. 3 is a plan view of one detail of the tourbillon timepiece movement according to the invention, with the Figure showing the stop member arranged to limit the axial shake of the carriage in the operating position, and with the tourbillon carriage omitted.
Figure 4:
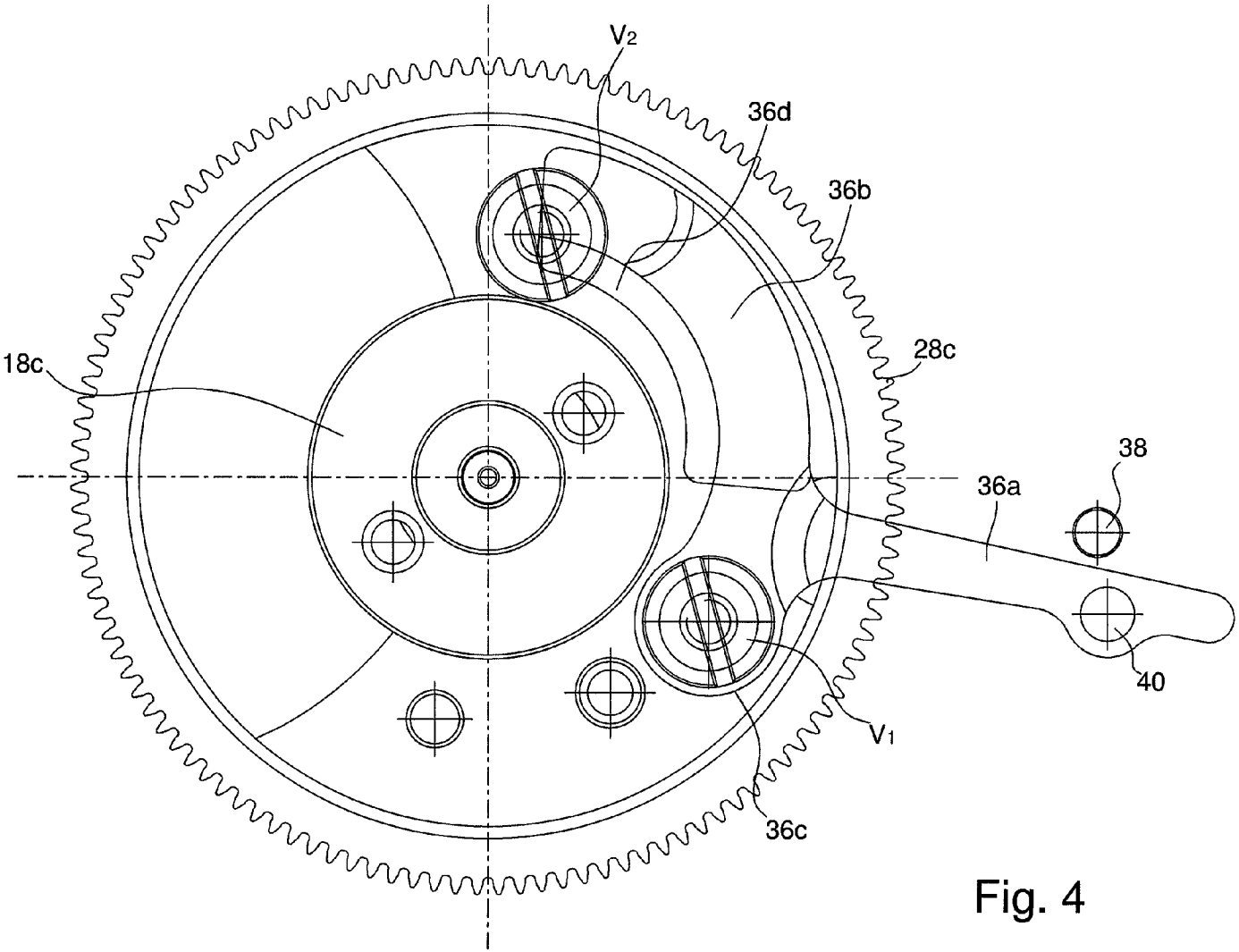
FIG. 4 is a plan view of one detail of the timepiece movement with a tourbillon according to the invention, with the Figure showing the stop member arranged to limit the axial shake of the carriage in the assembly position, and with the tourbillon carriage omitted.
Figure 5:
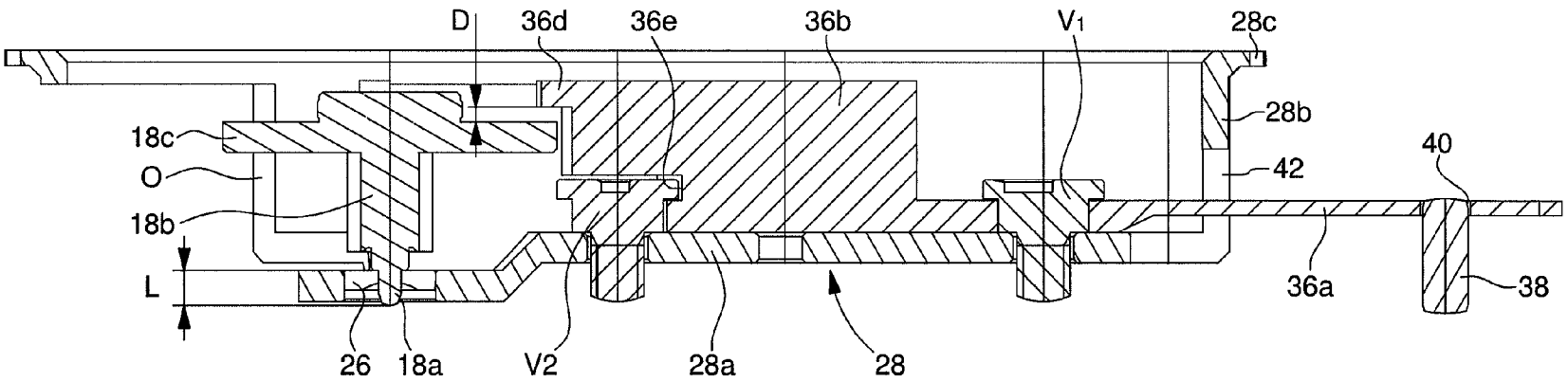
FIG. 5 is a cross-section along line V-V of FIG. 3, FIGS. 6 and 7 are respectively similar, perspective views to FIGS. 3 and 4, of one detail of the timepiece movement with a tourbillon according to the invention.
Figure 6:
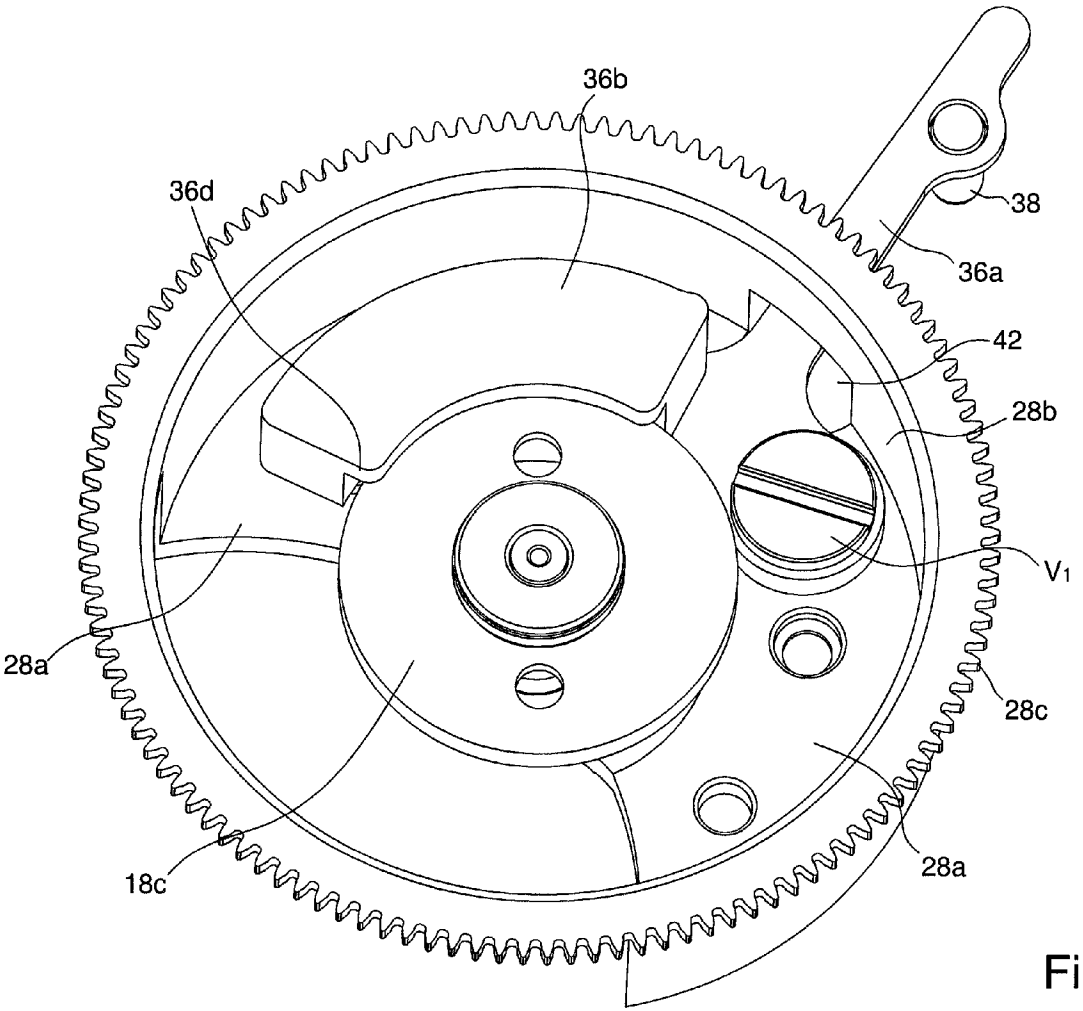
Figure 7:
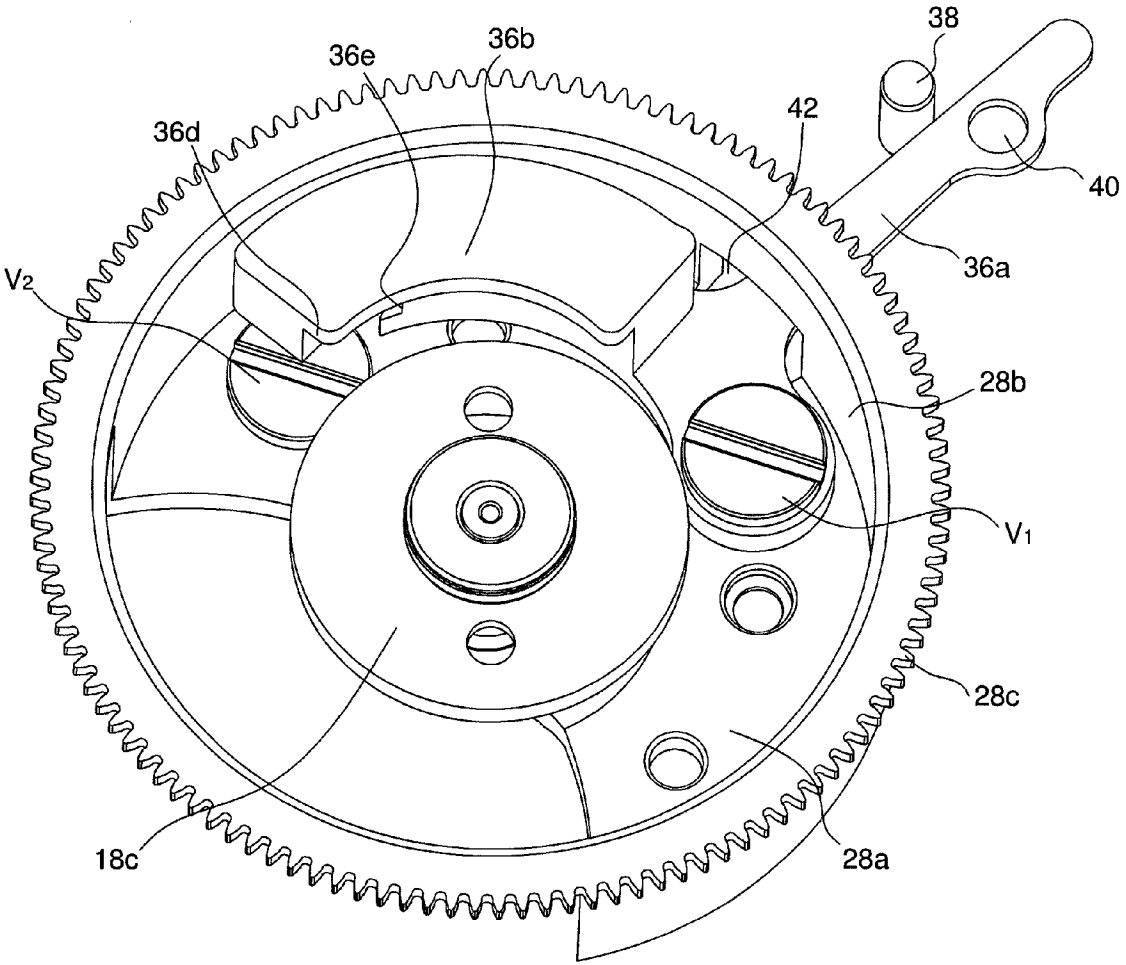

The timepiece movement with a tourbillon according to the invention, illustrated partially in FIGS. 1 and 2 and designated by the general reference 1 is, for example, to be fitted to a wristwatch that typically includes a case closed on top by a crystal and on the bottom by a back cover (not shown). Below the crystal there are hour and minute hands that rotate above a dial that largely covers timepiece movement 1. Timepiece movement 1 includes a tourbillon 10, which is visible in a window of the dial or in another opaque element, such as the bottom plate of the movement. In a conventional manner, tourbillon 10 includes a rotating carriage 12, which rotates about an arbour 14 around which the sprung balance 16, forming the regulating member, oscillates. The carriage carries, in a conventional manner, an escapement E that cooperates with the regulating member.

Tourbillon carriage 12 is held in place between two pivots, bottom pivot 18 and top pivot 20, respectively provided in bottom plate 22 of the movement and in a bridge 24 of the movement.

More specifically, and as is visible in FIG. 2, bottom pivot 18 of tourbillon carriage 12 rotates in a jewel 26 carried by bottom plate 22 of the movement via a cup-shaped part 28. Cup 28 includes a bottom 28*a*, which is extended by an annular wall 28*b*, which ends in a fixed toothing 28*c* that forms, in a known manner, the fixed toothed wheel 28*c* on which the tourbillon escape pinion $P_E$ rolls. In the example illustrated, toothing 28*c* extends outwards from cup 28.

It can also be seen that bottom pivot 18 is carried by a bottom bridge 30 of tourbillon 12. In the example shown, bottom bridge 30 includes a base plate 30*a*, which extends upwards in FIG. 2 via arms 30*b* that have a stepped configuration. Base plate 30*a* also includes a socket-shaped portion 30*c*, which extends downwards in FIG. 2 from its central part. Socket 30*c* carries pivot 18 into which it is driven in this example. The distal end of pivot 18 includes a stud 18*a*, which pivots in the housing of jewel 26. The median part of pivot 18 includes a toothed portion 18*b* which cooperates with a toothed wheel of the movement (not shown) driven by the mainspring thereof to set tourbillon carriage 12 in rotation. Thus, bottom bridge 30, via pivot portion 18*b*, forms the kinematic connection that links tourbillon carriage 12 to the rest of the timepiece movement. The proximal part of pivot 18 has a portion 18*c*, whose diameter is larger than the diameter of socket 30*c*, to define a shoulder 18*c*, carried by said socket.

It goes without saying that, according to a variant, bottom bridge 30 could be integral with pivot 18.

Base plate 30*a* also carries, in a conventional manner, escape bridge P and the bearings of the escape wheel set $M_E$ (FIG. 2) and pallets A.

Likewise, top pivot 20 of carriage 12 rotates in a jewel 32 carried by tourbillon bridge 24, which includes an overhanging beam 32 visible in FIGS. 1 and 2. This beam is secured to bottom plate 22 of the movement by means of screws. Top pivot 20 is carried by a top bridge 34 of carriage 12. In the example shown, top bridge 34 includes a base plate 34*a* which carries pivot 20. Base plate 34*a* extends downwards in FIG. 2 via arms 34*b* that also have a stepped configuration relative to arms 30*b* of bottom bridge 30 of carriage 12. Bottom and top bridges 30 and 34 of the carriage are secured to each other via their respective arms.

According to the invention, tourbillon timepiece movement 1 further includes a stop member 36 arranged for limiting the axial shake of tourbillon carriage 12, particularly in the event of any shocks that the watch undergoes, for example during a fall.

"Axial shake" means any movement of tourbillon carriage 12 along the axis of rotation 14, which may result from tourbillon bridge 24 bending in the event of a shock. By way of illustration and given the various manufacturing and assembly tolerances of the various elements in relation to each other, this shake may reach values of around 0.4 mm to 0.50 mm in the event of shocks, in the absence of any limiting means, such as stop member 36 provided by the invention.

In the embodiment illustrated in FIGS. 1 to 5, stop member 36 is carried by bottom plate 22 of the movement and cooperates with bottom bridge 30 of carriage 12.

More specifically, stop member 36 cooperates with shoulder 18*c* carried by bottom bridge 30. In the absence of any shock, the distance D (FIG. 5) between stop member 36 and shoulder 18*c* is less than the length of engagement L (FIG. 5) of stud 18*a* of bottom pivot 18 in the housing of bearing 26, formed in the example by a jewel. Thus, when the watch fitted to the tourbillon timepiece movement according to the invention undergoes a violent shock, the movement of carriage 12 caused by the shock cannot exceed the value D, such that stud 18*a* will not be able to leave its housing under any circumstances. Typically the distance D is around 0.20 mm, while length L is around 0.35 mm.

In the embodiment illustrated, stop member 36 is mounted to be mobile between a first position, called the assembly position (FIGS. 4; 7) in which stop member 36 is off the axial path of shoulder 18*c* to enable carriage 12 to be mounted on bottom plate 22; and a second position, called the operating position (FIGS. 3; 6) in which stop member 36 is on the axial path of shoulder 18*c*. Stop member 36 is hinged onto the bottom 28*a* of cup 28, typically by means of a screw V1 that passes through bottom 28*a* of cup 28 and is screwed onto bottom plate 24.

It will be noted in this regard that it is particularly advantageous to mount this stop member in the cup of the second steady pin of the tourbillon mechanism since it then occupies an existing volume in the mechanism that has been unused until now.

Stop member 36 takes the form of a hinged lever including a first control part 36*a*, in the form of a rectilinear arm extended by a second stop part 36*b*, which takes the form of a solid block shaped in the arc of a circle. Control arm 36*a* extends from an end part of block 36*b*, in which the hinged lever pivots at 36*c*. The thickness of solid block 36*b* is substantially greater than that of arm 36*a*. It can also be seen that the top, inner, peripheral edge of solid block 36*b* has a projecting portion 36*d*, defining a stop surface that is perpendicular to shoulder 18 when the stop member is in the operating position The bottom, inner, peripheral edge of solid block 36*b* also has a groove 36*e*, whose profile has a complementary shape to that of a screw V2, used both as a guide during pivoting and for axially blocking stop member 36 in the event of shocks.

In order to keep stop member 36 in the operating position, movement 1 further includes a locking member 38, which is formed of a pin driven into the bottom plate of the movement. This pin 38 will be housed in an oblong aperture 40 provided in control arm 36*a* of stop member 36 in the operating position. It will be noted in this regard that the annular wall 28*b* of cup 28 includes an oblong aperture 42 through which control arm 36*a* of stop member 36 extends. It will be noted in this regard that the cup also includes an aperture O for the passage of a drive wheel (not shown) of carriage 12 towards pinion 18*b*.

Making a stop member mobile between the aforementioned two positions facilitates assembly of the tourbillon. Indeed, once cup 28, fitted with bearing 26, has been assembled on bottom plate 22, stop member 36 is mounted in the bottom of the cup then pivoted into its assembly position, in which carriage 12 can easily be mounted in its pivots. Once the tourbillon carriage has been set in place, stop member 36 need only be pivoted and locked in its operating position, in which edge 36*c* of the block of member 36 is placed perpendicular to shoulder 18*c* of the bottom bridge of carriage 30. The axial shake of carriage 12 is thus limited, in all circumstances, to the distance D that separates shoulder 18*c* from edge 36*c*.

Figure 8:
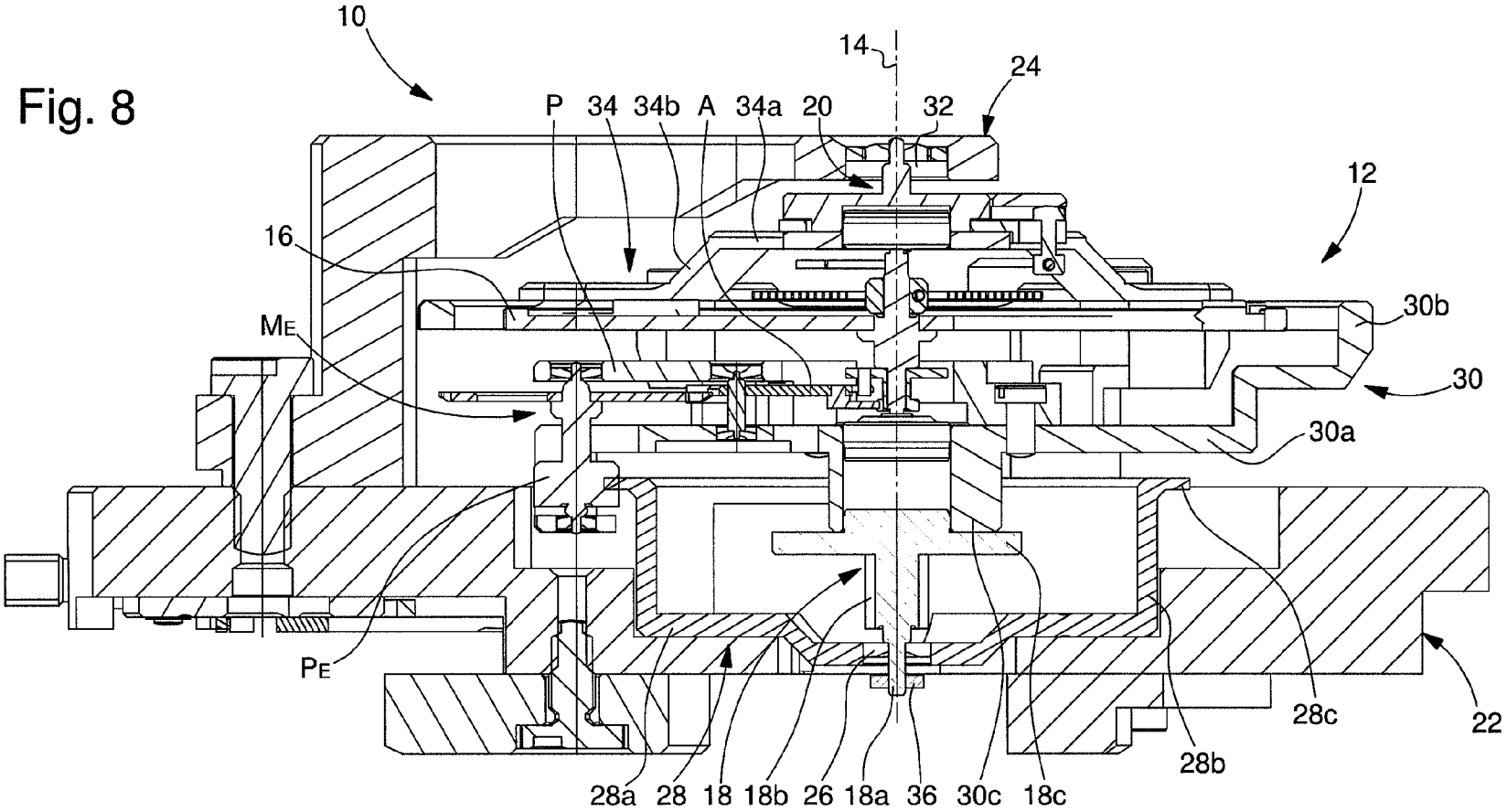
FIGS. 8 and 9 are partial cross-sections, similar to FIG. 2, of two variants of a second embodiment of a timepiece movement with a tourbillon according to the invention.

FIG. 8 shows partially a tourbillon timepiece movement according to a second embodiment of the invention in which those elements that are identical to those described with reference to FIGS. 1 to 7 are designated by the same reference numerals.

This second embodiment differs from that described with reference to FIGS. 1 to 7 in that stop member 36 is no longer carried by bottom plate 22, but by tourbillon carriage 12. In particular, stop member 36 is carried by stud 18*a* of bottom pivot 18 of the tourbillon carriage. In order to do this, the length of stud 18*a* of the bottom pivot is adapted so that it projects from bearing 26 on the opposite side to carriage 12 and the stop member is formed by a washer driven onto the projecting part of the bottom pivot stud. In a variant, the projecting part of stud 18*a* may include an annular groove and the washer may take the form of an elastic ring 36.

Figure 9:
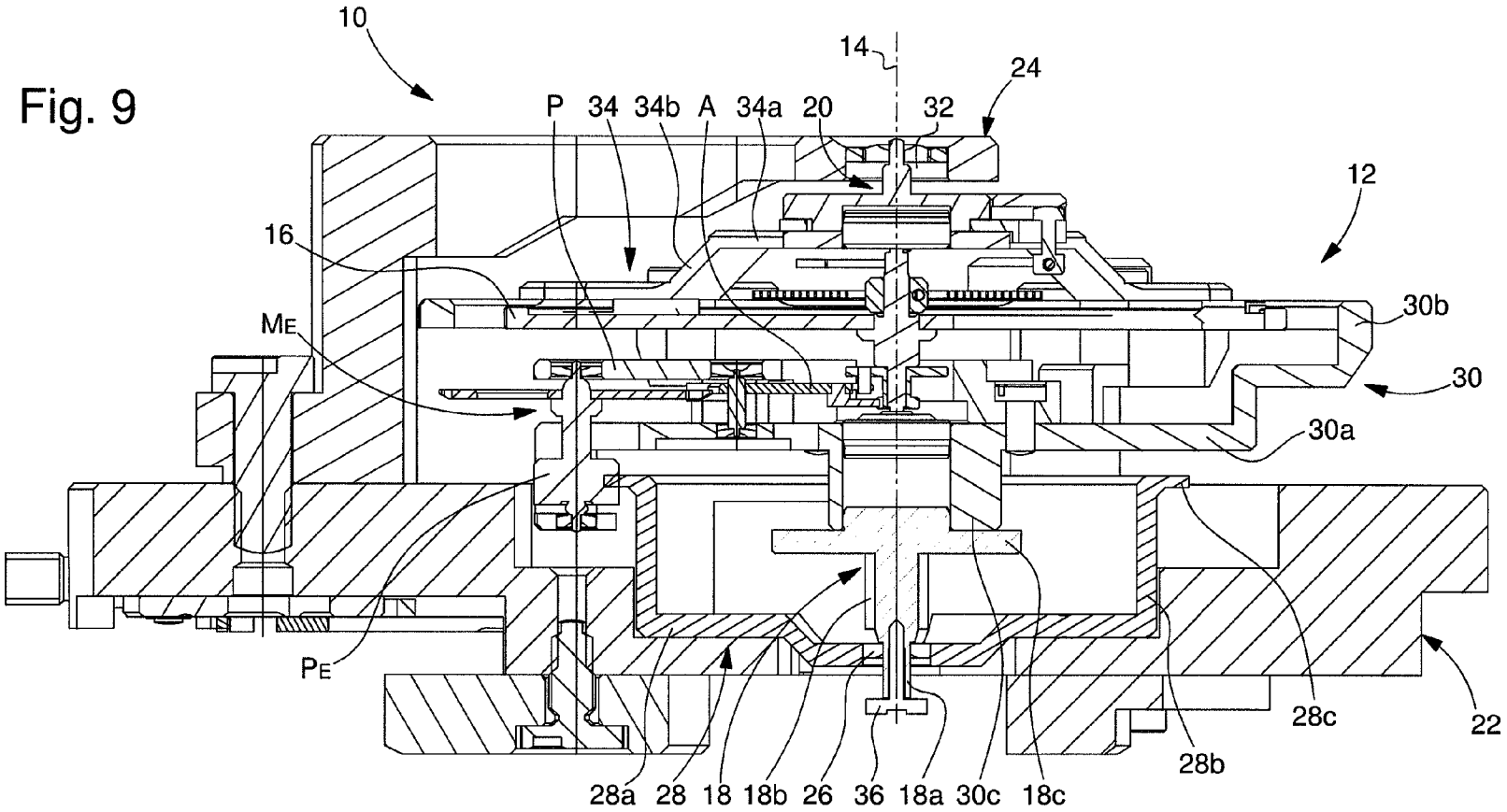

FIG. 9 shows another embodiment of the second embodiment of FIG. 9 in which the stop member is formed by the head of a screw that is axially screwed into the free end of the projecting part of the bottom pivot.

It goes without saying that the present invention is not limited to the embodiments that have just been described and that those skilled in the art can envisage various simple variants and alterations without departing from the scope of the invention defined by the annexed claims.

In particular, one could envisage mounting the stop member of the first embodiment so that it slides rather than pivots on the bottom plate of the movement or in the cup. In the first embodiment described above, two stop members could be provided, preferably arranged facing each other. In another variant of the first embodiment the stop member could be immobile. In this case, for example, it would be screwed into the bottom of the cup in the operating position from underneath the cup once the carriage had been mounted. Finally, according to yet another variant, the stop member could be mounted outside the cup at a distance from the bottom pivot, although it is advantageous to limit the shake to a place that is as close as possible to said pivot.

The tourbillion timepiece movement that has just been described concerned an application to a wristwatch, but it is clear that this application is in no way limiting and that the timepiece movement according to the invention can be used to equip other types of timepieces, such as, in particular, pocket watches.

What is claimed is:

1. A timepiece movement including a tourbillon that has a rotating carriage bearing a sprung balance and an escapement, wherein said carriage has a top pivot and a bottom pivot respectively carried by a top bridge and a bottom bridge of the carriage, and said carriage pivots respectively in a lower bearing and an upper bearing between a bottom plate of said timepiece movement and a bridge of said movement, said carriage having an axial shake, wherein said timepiece movement further includes a stop member, arranged for limiting the axial shake of said carriage between the bottom plate and the bridge wherein the stop member is different from the lower and upper bearings and wherein the carriage has an axial engagement length in said upper and lower bearings respectively, wherein the stop member, defines an axial travel of the carriage and wherein said axial travel is shorter than said axial engagement of the carriage in the upper and lower bearings respectively so that said carriage pivots remain engaged in their respective bearing as a consequence of a deformation of a bridge upon a shock.

2. The timepiece movement according to claim 1, wherein the stop member is carried by the bottom plate of the movement.

3. The timepiece movement according to claim 2, wherein the bottom bridge of the carriage has a central part, wherein a socket carrying the bottom pivot extends from the central part of the bottom bridge of the carriage, wherein the socket carries a shoulder and wherein the stop member cooperates with said shoulder to limit the axial shake of the carriage.

4. The timepiece movement according to claim 3, wherein the bottom pivot is housed in said bottom bearing carried by the bottom plate, wherein said bottom pivot is engaged over a length of engagement in said bottom bearing, when there are no shocks, and wherein, the distance between the stop member and said shoulder is less than the length of engagement of the bottom pivot in the bearing associated therewith.

5. The timepiece movement according to claim 4, wherein said stop member is mobile between a first position, called the assembly position, in which the stop member is off the axial path of said shoulder, to allow the carriage to be mounted on the bottom plate, and a second position, called the operating position, in which the stop member is on the axial path of said shoulder.

6. The timepiece movement according to claim 5, wherein the stop member takes the form of a hinged lever that includes a first control part, extended by a second stop part in the shape of an arc of a circle, wherein the control part is located in an end portion of said second part, in which the hinged lever pivots.

7. The timepiece movement according to claim 6, further including a member for locking the stop member in the operating position.

8. The timepiece movement according to claim 7, wherein the locking member is formed of a pin that is housed in an aperture provided in the control part of the stop member.

9. The timepiece movement according to claim 6, including an escape pinion part in the form of a cup, secured to the bottom plate and wherein the bottom of the cup is extended by an annular wall that ends in an edge provided with a fixed toothing, on which the escape pinion rolls, and into which the socket bearing the bottom pivot of the carriage extends, wherein the stop member is hinged in the cup.

10. The timepiece movement according to claim 9, wherein the annular wall of said cup has an oblong aperture, through which said control part of the stop member extends.

11. The timepiece movement according to claim 1, wherein the stop member cooperates with the bottom bridge of said carriage.

12. The timepiece movement according to claim 1, wherein the stop member is carried by the tourbillon carriage.

13. The timepiece movement according to claim 12, wherein the stop member is carried by the bottom pivot of the tourbillon carriage.

14. The timepiece movement according to claim 13, wherein said bottom bearing has a side facing said carriage and a side facing a direction opposite to said carriage, wherein the bottom pivot projects outside the bearing thereof on the opposite side to said carriage and wherein the stop member is formed by a washer driven onto said projecting part of the bottom pivot.

15. The timepiece movement according to claim 13, wherein said bottom bearing has a side facing said carriage and a side facing a direction opposite to said carriage, wherein the bottom pivot projects outside the bearing thereof on the opposite side to said carriage, wherein said projecting part has a free end and wherein the stop member is formed by the head of a screw that is axially screwed into the free end of said projecting part of the bottom pivot.

16. The timepiece movement according to claim 1, wherein the stop member is configured as a lever.

* * * * *